US005392484A

United States Patent [19]

Stoltzfus

[11] Patent Number: 5,392,484

[45] Date of Patent: Feb. 28, 1995

[54] BULLNOSE CORNER CLEANING TOOL

[76] Inventor: John Stoltzfus, P.O. Box 8077, Mammoth Lakes, Calif. 93546

[21] Appl. No.: 161,780

[22] Filed: Dec. 2, 1993

[51] Int. Cl.[6] ..... B05C 17/00

[52] U.S. Cl. ..... 15/235.7; 15/143.1; 15/236.07; 15/245.1; 425/458; D8/45; D32/49

[58] Field of Search ..... 15/105.5, 235.3, 235.4, 15/235.6, 235.7, 236.7, 236.01, 236.03, 236.05, 236.07, 236.09, 245.1, 143.1; 425/458; D8/45; D32/46, 49

[56] References Cited

U.S. PATENT DOCUMENTS

| | | | |
|---|---|---|---|
| 407,562 | 7/1889 | Agan | 15/236.07 |
| 1,327,151 | 1/1920 | Frazier | 15/235.3 |
| 2,701,465 | 2/1955 | Johnson et al. | 15/237.7 |
| 2,934,936 | 5/1960 | Vernon | 15/235.4 |
| 2,944,275 | 7/1960 | Markusen | 15/236.01 |
| 3,686,703 | 8/1972 | Ray | 15/235.4 |
| 4,355,432 | 10/1982 | Storm, Jr. | 15/236.07 |
| 4,669,970 | 6/1987 | Perry | 15/235.7 |

FOREIGN PATENT DOCUMENTS

| | | | |
|---|---|---|---|
| 3644606 | 7/1988 | Germany | 15/235.4 |
| 86887 | 2/1956 | Norway | 15/236.07 |

*Primary Examiner*—Mark Spisich
*Attorney, Agent, or Firm*—Lynn & Lynn

[57] ABSTRACT

A tool for cleaning and finishing bullnose joints between adjacent sheets of drywall or the like has a handle configured for grasping by a user and a head that includes a working section. The head is formed generally as a section of a thin-walled hollow cylinder having a concave side and a convex side. The working portion is the front edge of the head, which is configured to finish drywall joints of selected angles. The front edge further includes a curved recess. The curved recess in the concave side of the head is used for finishing a drywall joint of a first selected angle and the convex side is used for finishing a drywall joint of a second selected angle.

2 Claims, 5 Drawing Sheets

BULLNOSE CORNER CLEANING TOOL

BACKGROUND OF THE INVENTION

This invention relates generally to tools used in building construction and particularly to a hand tool for finishing corner joints in drywall. This invention relates particularly to a tool for finishing and cleaning bullnose corner joints.

Bullnose corners are often used in construction using drywall. A curved metal strip is placed between two drywall sheets that meet at an angle. A finishing compound is then applied over the metal strip before the drywall is painted. Typical angles for drywall corners are 90° and 135°. Bullnose corners are sometimes formed in drywall adjacent a door jamb. There is a need in the art for a tool that permits a drywall finisher to finish bullnose joints cleanly and quickly,

SUMMARY OF THE INVENTION

This invention provides a bullnose finishing tool that allows a drywall finisher to finish bullnose corners much more quickly than with previously used tools. The present invention may be used to finish corners of more that one angle. The present invention also may be used to finish a bullnose drywall corner adjacent a door jamb while forming and cleaning a kerf adjacent the door jamb.

A tool according to the present invention for cleaning and finishing bullnose joints between adjacent sheets of drywall or the like, comprises a handle configured for grasping by a user and a head connected to the handle. The head extends from the handle generally in longitudinal alignment with the handle. The head preferably is formed generally as a section of a thin-walled hollow cylinder having a concave side and a convex side. The head has a front edge as the working portion for contacting a drywall joint to be finished. A curved recess in the front edge has an edge that contacts the join to be finished. The curved recess is configured to conform to bullnose corners of selected angles, such that the curved recess portion of the head in the concave side of the head is configured for finishing a drywall joint of a first selected angle and the convex side is configured for finishing a drywall joint of a second selected angle. The first selected angle is 90° and the second selected angle is 135°, although the principles of the invention may be used to form a tool for cleaning drywall joints of any angle.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 1:
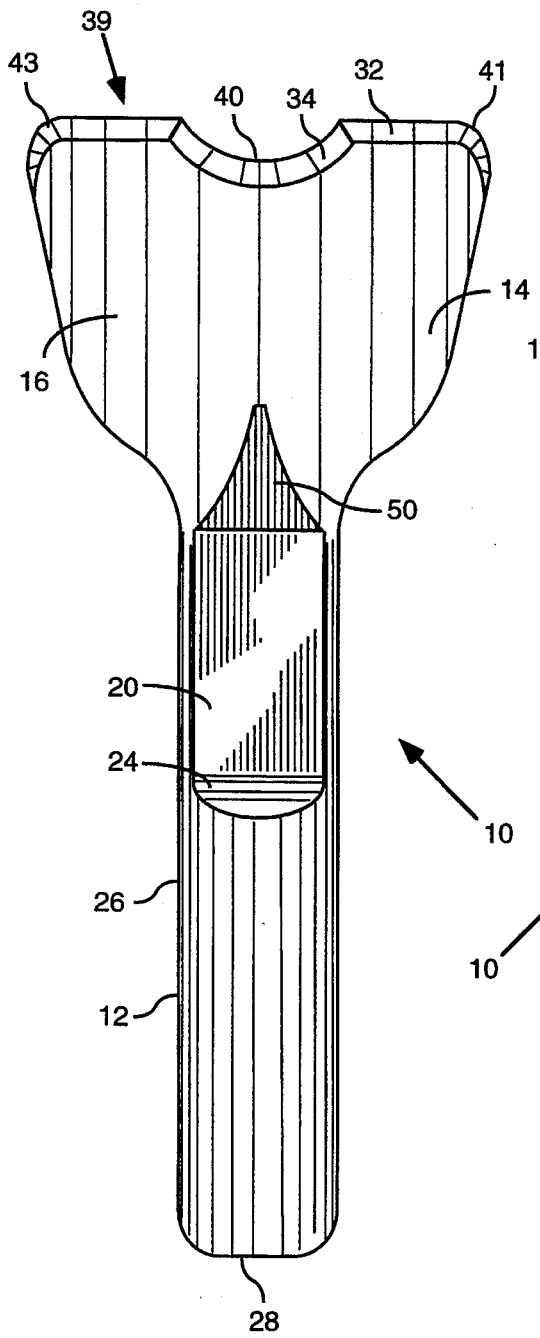
FIG. 1 is a top plan view of view of a drywall finishing tool according to the present invention.
Figure 2:
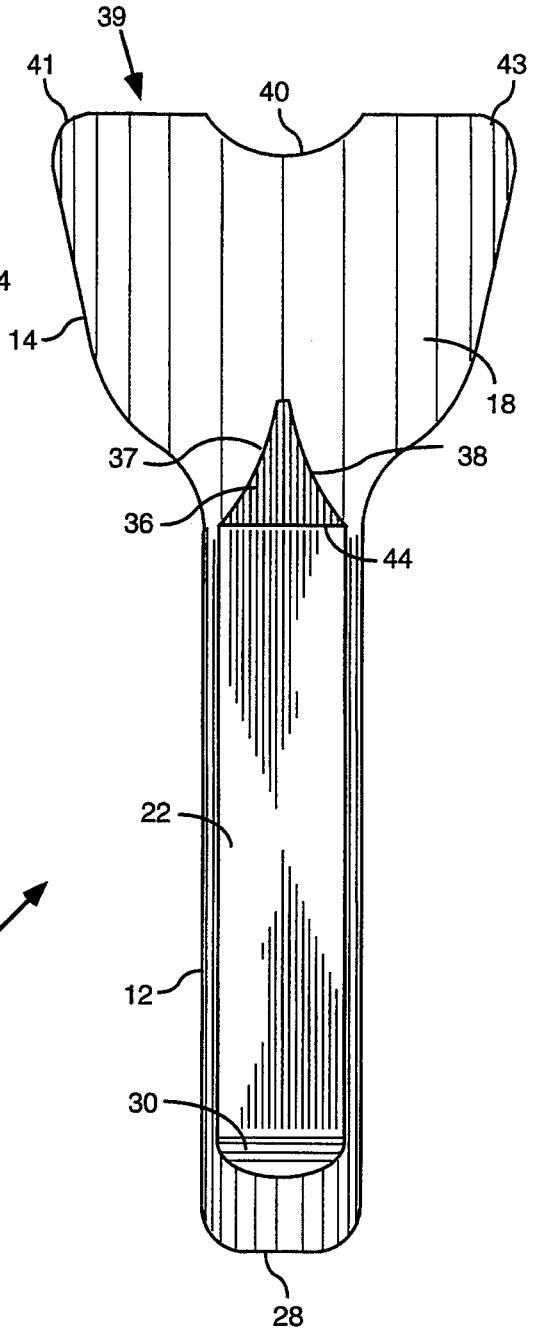
FIG. 2 is a bottom plan view of the drywall finishing tool of FIG. 1.
Figure 3:
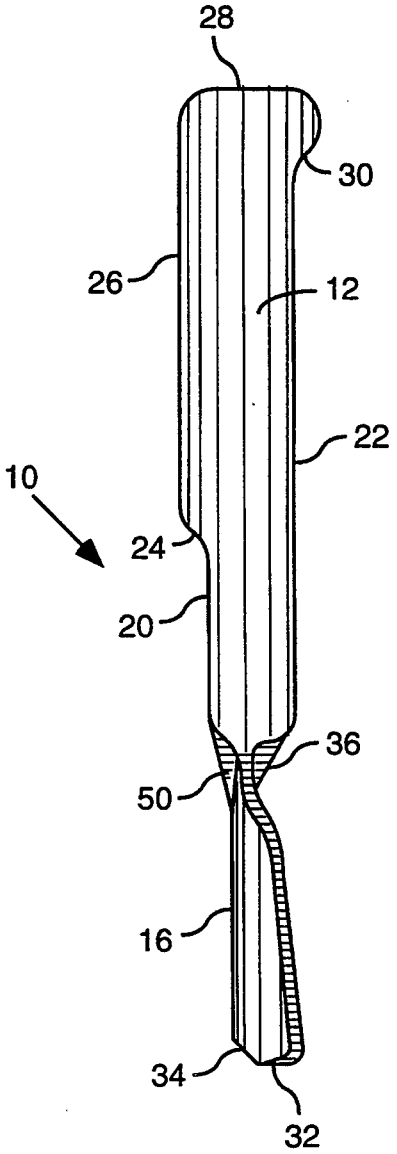
FIG. 3 is a side elevation view of the drywall finishing tool of FIGS. 1 and 2.

Referring to FIGS. 1–3, a drywall finishing tool 10 according to the present invention includes a handle 12 and a head 14. The head 14 has two working sides 16 and 18. The side 16 is convex, and the side 18 is concave. As shown in FIGS. 1–3, the handle 12 is formed generally as an elongate cylinder with flattened portions 20 and 22 formed thereon.

Figure 6:
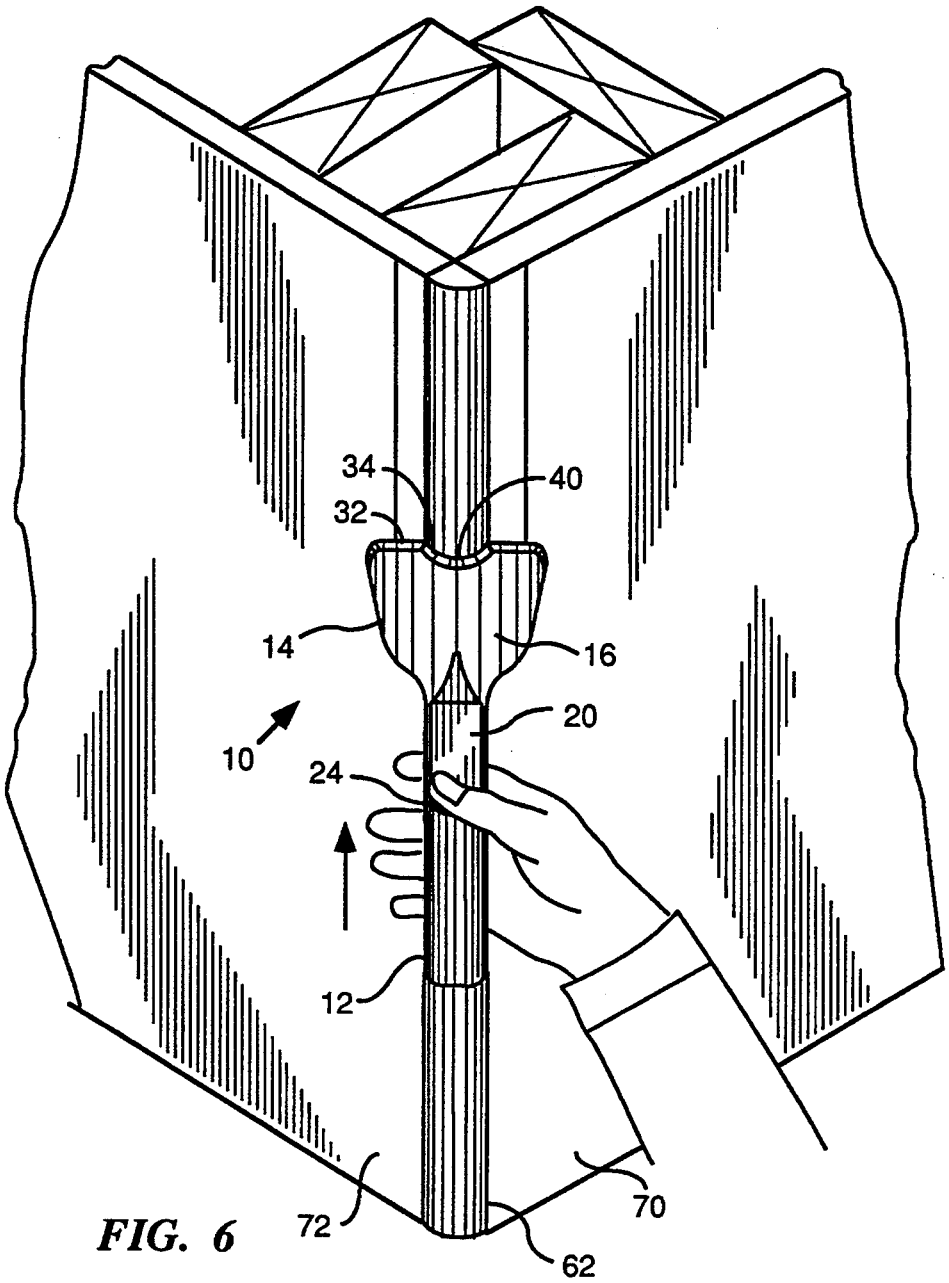
FIG. 6 illustrates the drywall finishing tool according to the present invention being used to finish a 90° outside corner at a junction of two sheets of drywall.
Figure 7:
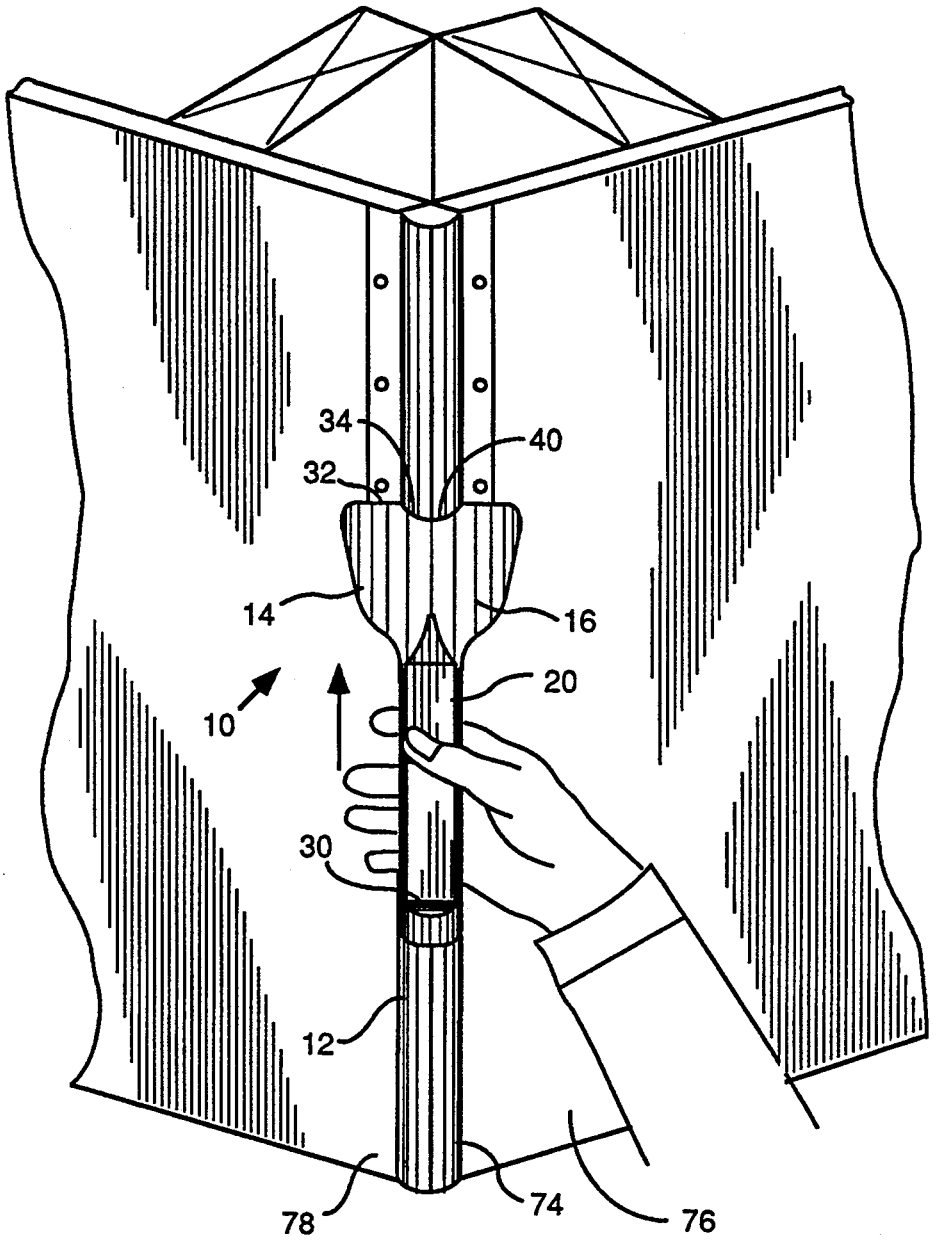
FIG. 7 illustrates the drywall finishing tool according to the present invention being used to finish a 135° outside corner at a junction of two sheets of drywall.

The flattened portion 20 extends from the head 14 for a distance of about 1.5 in. In a preferred embodiment, the handle 12 is about four to five inches in length, however; the exact length of the handle is not an essential feature of the invention. Referring to FIGS. 1, 3, 7 and 8 the handle 12 includes a curved transition 24 between the flattened portion 20 and the rounded portion 26. The curved portion 24 is convenient for use as thumb-rest when the working side 18 of drywall finishing tool 10 is in use to finish certain types of drywall joints. Referring to FIG. 6, when the working side 16 is in use, the user's forefinger may be conveniently placed on the curved portion 24.

Referring to FIGS. 2, 3 and 6, the flattened portion 22 extends nearly the entire length of the handle 12. The end 28 of the handle 12 distal from the head 14 is generally circular. A curved transition portion 30 is formed between the flattened portion 22 and the circular end 28. The cylindrical portion of the handle 12 is about one inch in diameter.

The head 14 has a leading edge 32 that extends about 2.25 in. from the end of the handle proximate the head 14. The leading edge 32 has a beveled edge portion 34 as shown in FIGS. 1 and 3. The beveled edge portion 34 preferably makes angle of 45° with the longitudinal axis of the handle 12. The head 14 preferably has a thickness of about 0.01–0.015 in.

Figure 4:
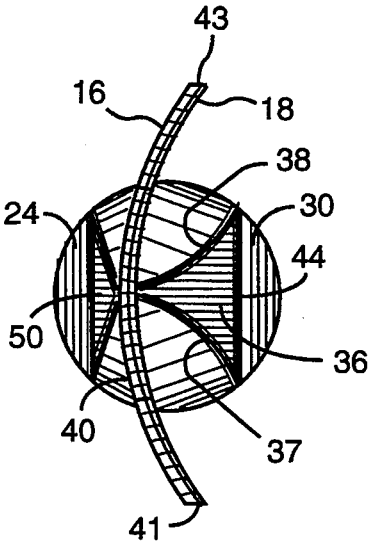
FIG. 4 is a front end elevation view of the drywall finishing tool of FIGS. 1–4.
Figure 5:
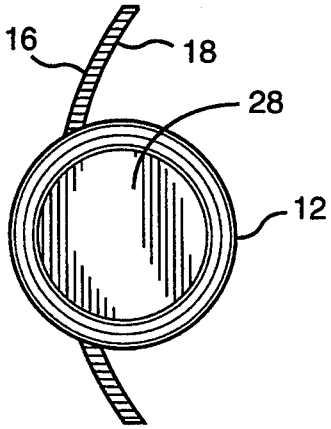
FIG. 5 is a rear end elevation view of the drywall finishing tool of FIGS. 1–5.

The head 14 fans out from the handle 12 to a width of about 2.75–3.0 in. The width of the head is selected to provide adequate strength in the material from which the drywall finishing tool 10 is formed to support the working edges when they are engaged with drywall finishing compound. Referring to FIGS. 4 and 5, the head 14 is curved such that its extreme ends 38 and 39 span an arc of about 75°.

Referring to FIGS. 1 and 2, the leading edge 32 has a central curved portion that is shown as a recess 40 in the end of the head distal from the handle 12. When the drywall finishing tool 10 is in use, the curved portion 40 is the working portion that is placed in contact with the drywall joint to be finished. In a preferred embodiment, the plan view of the recess 40 is approximately a one inch diameter circular arc of about 120°. The diameter of the arc depends upon the diameter of the finished bullnose corner desired.

Referring to FIGS. 2–4, a tapered section 36 is formed at the juncture of the handle 12 and the working side 18 of the head 14. The tapered section 36 provides strain relief and helps support me head 14 with sufficient rigidity on the handle 12. In the plan view of FIG. 2 the tapered section 36 includes two convexly curved edges 37 and 28 that extend from opposite sides of the handle 12 and converge toward the longitudinal center line of the drywall finishing tool 10. An edge 44 that is perpendicular to the longitudinal axis of the drywall finishing tool 10 defines the line of contact between the handle and the tapered section. Referring to FIG. 3, the edge 44 is displaced about 0.25–0.4 in. from the concave surface 18. The tapered section 36 tapers from the edge 44 to be flush with the concave surface 18.

Referring to FIGS. 1, 3 and 4 a tapered section 50 is formed between the handle 12 and the working side 16 of the head 14. The tapered section 50 has a shape similar to that of the tapered section 36. The tapered sections 36 and 50 cooperate to support the head 14 upon the end of the handle 12 in a manner adequate for normal use of the drywall finishing tool 10.

Referring to FIG. 6, the drywall finishing tool 10 may be used to finish a 90° bull nose corner 62 between two sheets of drywall 70 and 72. The unbeveled portion of the leading edge 32 in the recess 40 of the concave working side 18 is pressed against the drywall finishing compound while the drywall finishing tool 10 is advanced in the direction of its leading edge 32. Excess finishing compound is removed, leaving the clean 90° bullnose corner 62. The angle of the handle 12 relative to the vertical should be adjusted by the user to make the finished corner 62 conform to the desired 90° configuration Referring to FIG. 7, the drywall finishing tool 10 may be used to finish a 135° bullnose corner 74 between two sheets of drywall 76 and 78. The beveled portion 34 of the edge of the convex working side 16 is pressed against the drywall finishing compound while the drywall finishing tool 10 is advanced in the direction of its front edge. Excess finishing compound is removed, leaving the clean 135° bullnose corner 74.

Figure 8:
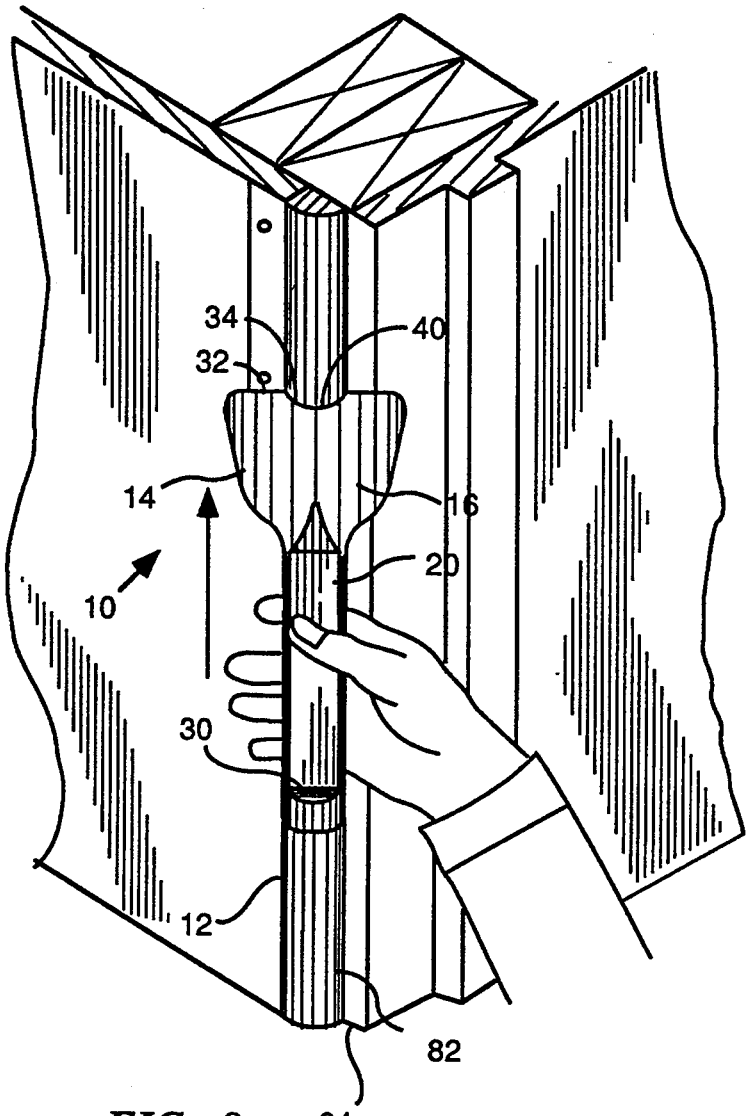
FIG. 8 illustrates the drywall finishing tool according to the present invention being used to finish a joint between a sheet of drywall and a door jamb.

Referring to FIG. 8, the drywall finishing tool 10 may also be used to clean and finish a bullnose corner 82 adjacent a door jamb 84. The beveled portion 34 of the edge of the convex working side 16 is pressed against the drywall finishing compound while the drywall finishing tool 10 is advanced in the direction of its front edge. Excess finishing compound is removed, leaving the clean 135° bullnose corner 74.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A tool for cleaning and finishing bullnose joints between adjacent sheets of drywall, comprising:

an elongated handle configured for grasping by a user; and a head connected to the handle, the head being formed generally as a section of a thin-walled hollow cylinder having a concave side and a convex side, the head having a front edge as the working portion for contacting a drywall joint to be finished, the convex side of the head having a beveled portion adjacent the front edge, the front edge further having a curved recess therein bounded on opposite sides thereof by two substantially straight edges, the edges located in a plane substantially perpendicular to the longitudinal axis of the handle, the curved recess being configured to conform to bullnose corners of selected angles, such that the curved recess in the concave side of the head is configured for finishing a drywall joint of a first selected angle and the convex side is configured for finishing a drywall joint of a second selected angle.

2. A tool for cleaning and finishing bullnose joints between adjacent sheets of drywall, comprising:

an elongated handle configured for grasping by a user, opposite sides of the handle having:

a rounded portion adjacent a flattened portion;

a curved portion between the flattened portion and the rounded portion, the curved portion being formed for use as a support for the user's fore finger when a first working side of the tool is in use and for use as a thumb rest when a second working side of the tool is in use; and a head connected to the handle, the head being formed generally as a section of a thin-walled hollow cylinder having a concave side and a convex side, the head having a front edge as the working portion for contacting a drywall joint to be finished, the convex side of the head having a beveled portion adjacent the front edge, the front edge further having a curved recess therein bounded on opposite sides thereof by two substantially straight edges, the edges located in a plane substantially perpendicular to the longitudinal axis of the handle, the curved recess being configured to conform to bullnose corners of selected angles, such that the curved recess in the concave side of the head is configured for finishing a drywall joint of a first selected angle and the convex side is configured for finishing a drywall joint of a second selected angle.

* * * * *